United States Patent [19]

Okumoto

[11] Patent Number: 4,693,261

[45] **Date of Patent: * Sep. 15, 1987**

[54] CONTINUOUS CIGARETTE ROD CUTTING APPARATUS FOR A CIGARETTE MAKING MACHINE

[75] Inventor: Yutaka Okumoto, Musashino, Japan

[73] Assignee: The Japan Tobacco & Salt Public Corporation, Tokyo, Japan

[ * ] Notice: The portion of the term of this patent subsequent to Sep. 15, 2004 has been disclaimed.

[21] Appl. No.: 705,890

[22] Filed: Feb. 26, 1985

[30] Foreign Application Priority Data

May 2, 1984 [JP] Japan ..... 59-87776

[51] Int. Cl.[4] ..... A24C 5/28

[52] U.S. Cl. ..... 131/84.1; 131/84.4; 131/65; 83/310

[58] Field of Search ..... 131/84.4, 84.1, 65; 83/174, 310, 341, 355, 356.3, 592, 311, 354; 51/247

[56] References Cited

U.S. PATENT DOCUMENTS

| | | | |
|---|---|---|---|
| 1,846,942 | 2/1932 | Bronander et al. | 83/341 |
| 3,140,632 | 7/1964 | Rowlands et al. . | |
| 3,176,560 | 4/1965 | Bardenhagen | 83/174 |
| 3,476,002 | 11/1969 | Bardenhagen | 83/310 |
| 3,479,913 | 11/1969 | Goemann et al. | 83/310 |
| 3,518,911 | 12/1969 | Niemann et al. . | |
| 3,604,162 | 9/1971 | Preston et al. | 51/247 |
| 3,712,160 | 1/1973 | Preston et al. | 131/84.4 |
| 3,728,923 | 4/1973 | Lanore | 83/310 |
| 3,753,379 | 8/1973 | Molins et al. | 83/174 |
| 3,772,952 | 11/1973 | Gianese | 83/310 |
| 3,815,460 | 6/1974 | Bardenhagen | 83/310 |
| 3,863,536 | 2/1975 | Legardinier | 83/310 |
| 3,956,955 | 5/1976 | Marritt | 83/310 |

FOREIGN PATENT DOCUMENTS

| | | |
|---|---|---|
| 294905 | 1/1927 | United Kingdom . |
| 652561 | 9/1948 | United Kingdom . |
| 1387419 | 10/1971 | United Kingdom . |
| 1581723 | 4/1976 | United Kingdom . |

*Primary Examiner*—V. Millin
*Assistant Examiner*—H. Macey
*Attorney, Agent, or Firm*—Schwartz, Jeffery, Schwaab, Mack, Blumenthal & Evans

[57] ABSTRACT

Cutting edges, for cutting a continuous cigarette rod at right angles to the longitudinal direction thereof, protrude from a rotating head which is tilted with respect to the travelling direction of the continuous cigarette rod. A pair of fixed guide members face each other in cutting positions for the continuous cigarette rod. The guide members are spaced so that the cutting edge may pass between them without oscillation. As the rotating head rotates, the cutting edge cuts the continuous cigarette rod.

8 Claims, 8 Drawing Figures

CONTINUOUS CIGARETTE ROD CUTTING APPARATUS FOR A CIGARETTE MAKING MACHINE

BACKGROUND OF THE INVENTION

The present invention relates to a cutting apparatus for cigarette making machines for vertically cutting a horizontally moving cigarette rod into cigarettes.

Simple cutting apparatuses of this type are conventionally used in which a cutting edge is rotated and moved in the same direction as a cigarette rod by means of a universal joint, to cut the cigarette rod which is guided in a ledger. These apparatuses are disclosed in, for example, U.S. Pat. No. 3,176,560 and Japanese Patent Publication No. 9840/76. In these apparatuses, however, if the universal joint is driven at high speed, its vibration and hence the vibration of the cutting edge are augmented resulting in the cut faces of the cigarettes being jagged, which leads to the lowering of the commercial value of the cigarettes.

In order to eliminate the above drawback, apparatuses have been developed in which a rotating member with a tilted rotating shaft is used in place of the universal joint so that the cutting edge is mounted on the rotating member and moved at a uniform speed, as disclosed in U.S. Pat. Nos. 3,604,162 and 3,753,379. In these apparatuses, the ledger is moved for acceleration and deceleration as the cutting edge moves. These apparatuses are not, however, provided with fully effective means for movably supporting the ledger for acceleration and deceleration. Moreover, such a manner of moving the ledger is not satisfactory because it will place restrictions on high-speed operation.

Apparatuses of another type, as are disclosed in U.S. Pat. Nos. 3,479,913, 3,728,923, 3,772,952, 3,863,536 and 3,956,955, are conventionally known in which the ledger is rotatable. However, the apparatuses of this type cannot easily synchronize the movements of the ledger and the cutting edge at high speed, and are unfit for high-speed operation. In this arrangement, moreover, the ledger cannot cover the whole circumference of the cigarettes, and the cut faces of the cigarettes are not as smooth as they should be.

SUMMARY OF THE INVENTION

The object of the present invention is to provide a cutting apparatus which is simple in construction and is capable of preventing vibration in the cutting edges even in high-speed operation. These features would mean a machine could cut a cigarette so that it has a smooth vertical face without indentation, and thus be adapted for use in high-speed cigarette making machines.

According to the present invention, there is provided a cutting apparatus which comprises a rotating member rotatable around an axis of rotation tilted with respect to the travelling direction of a continuous cigarette rod, drive means for rotating the rotating member, at least one cutting edge attached to the rotating member so as to extend at right angles to the travelling direction of the continuous cigarette rod and to rotate together with the rotating member, the cutting edge being adapted to cut the moving continuous cigarette rod at right angles to the travelling direction thereof, and a pair of fixed guide members each having a hole through which the continuous cigarette rod travels and an inner surface, the respective inner surfaces of the two guide members facing each other at a space wider than the thickness of the cutting edge so that the cutting edge passes between the inner surfaces of the guide members to cut the continuous cigarette rod, whereby the cutting edge passing between the inner surfaces to reach the continuous cigarette rod is prevented from vibrating in the direction of the thickness thereof by touching the inner surfaces.

DETAILED DESCRIPTION OF THE PREFERRED EMBODIMENT

Figure 1:
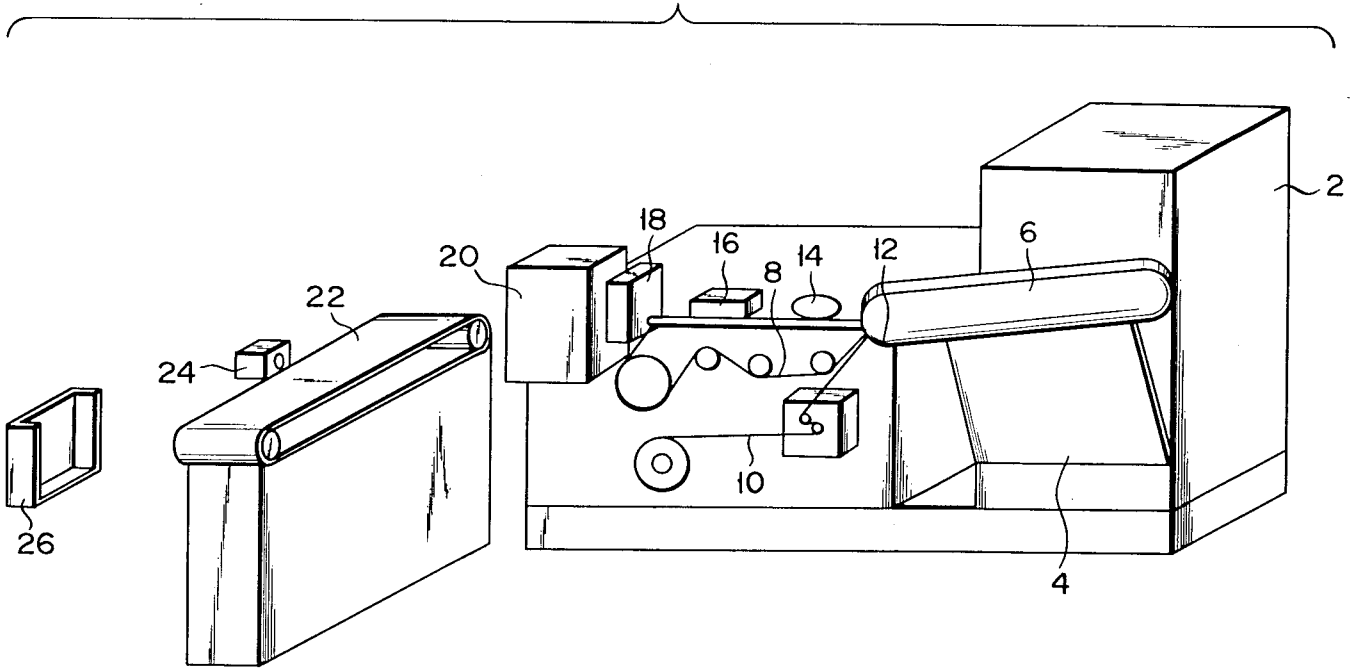
FIG. 1 is a perspective view schematically showing an outline of a cigarette making machine.

Referring now to FIG. 1, a cigarette making machine with a continuous cigarette rod cutting apparatus according to one embodiment of the present invention will now be described in detail.

Cut tobacco for making the cigarette rod, in a supply unit 2 is fed upward through a narrow passage 4 by air as a conveying medium, and sucked into a suction chamber 6 to form a layer with a predetermined thickness on a perforated conveyor which is disposed at the lower portion of the suction chamber 6.

The layer of out tabacco is fed to the left of FIG. 1, and adjusted to the predetermined thickness by an adjusting unit 12. The cut tobacco is transferred onto a wrapper web 10 which is superposed on a garniture tape 8, passed through a tapered duct (not shown) in the next stage, and then compressed. The compressed cut tobacco is wrapped in the wrapper web 10, and paste is applied to one side end portion of the wrapper web 10 by a paste applicator 14 and dried by a heater 16. Thus, the wrapper web 10 is pasted, and a continuous cigarette rod is completed.

Thereafter, the density of the continuous cigarette rod is detected by a density detector 18 using radiation. The continuous cigarette rod is cut into pieces or cigarettes of a predetermined length by a cigarette cutting apparatus 20. These cigarettes are fed by a conveyor 22. Defective cigarettes are removed by a solenoid valve 24 at the peripheral portion of the conveyor 22 so that only non-defective cigarettes are loaded into a tray 26.

Figure 2:
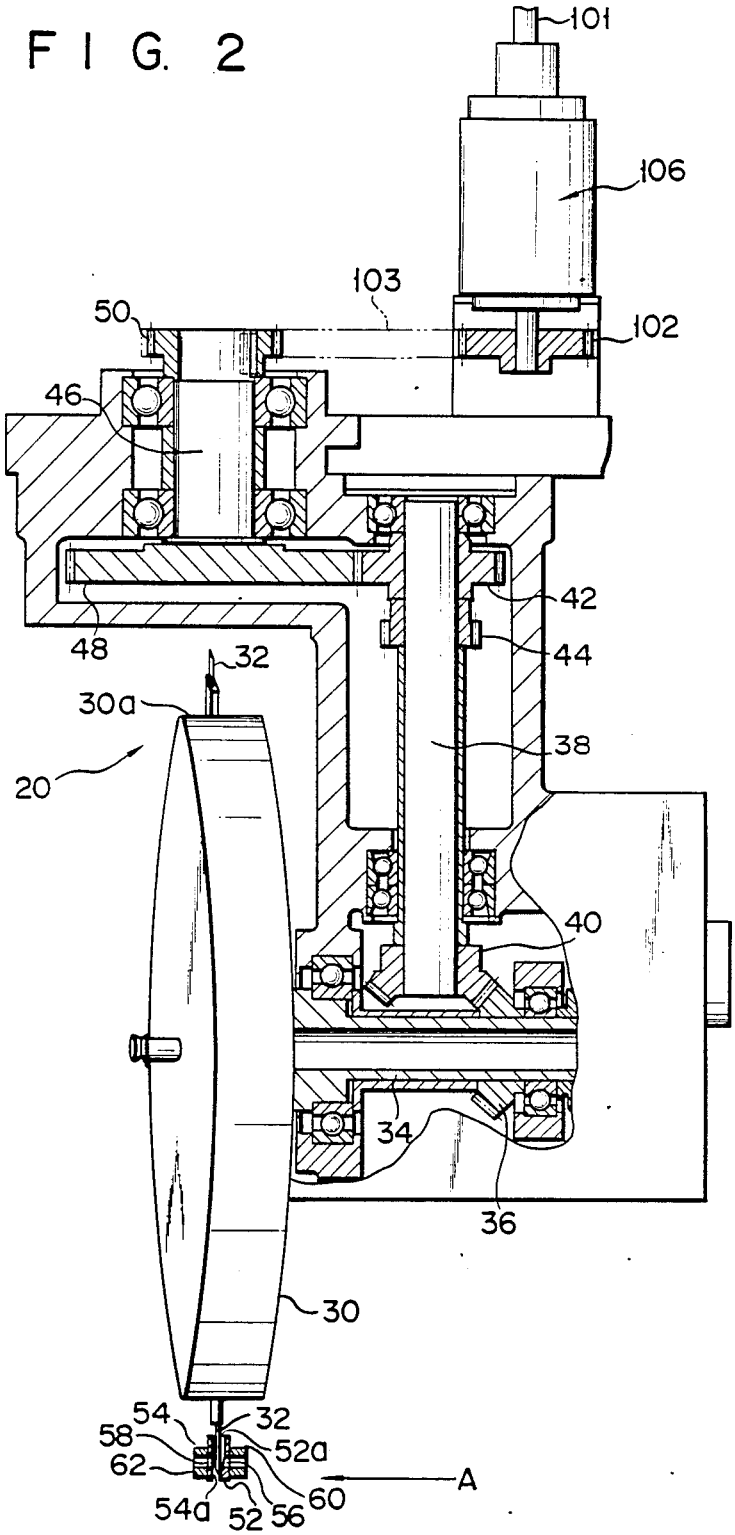
FIG. 2 is a sectional view of a continuous cigarette rod cutting apparatus for a cigarette making machine according to one embodiment of the present invention, as taken along line II—II of FIG. 5, additionally showing first and second guide members.
Figure 3:
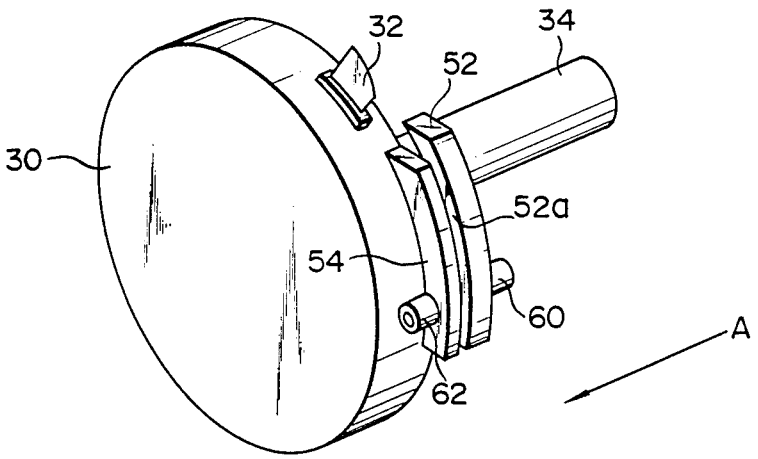
FIG. 3 is a perspective view of a rotating head shown in FIG. 2.
Figure 5:
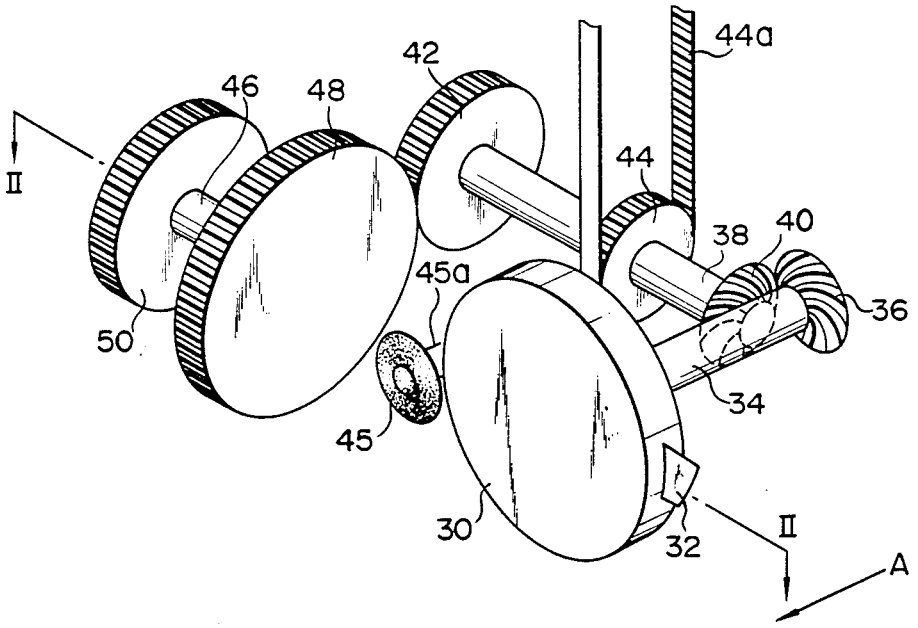
FIG. 5 is a schematic perspective view of the continuous cigarette cutting apparatus for a cigarette making machine according to one embodiment of the invention.
Figure 6:
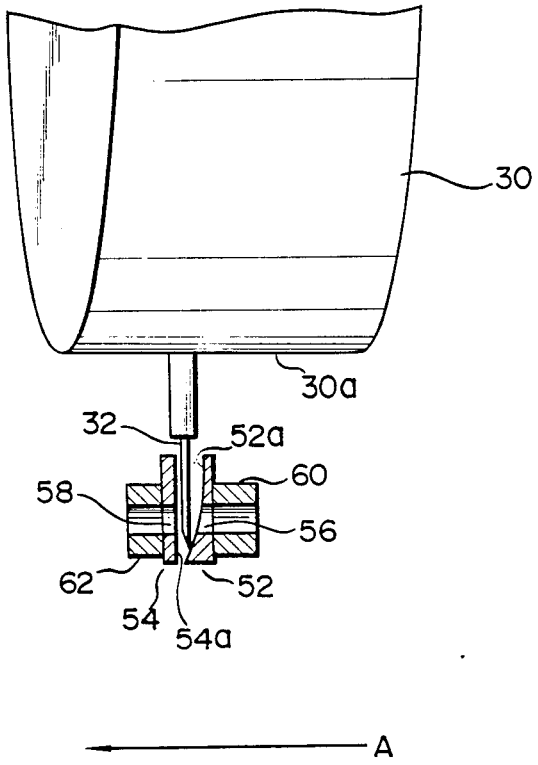
FIG. 6 is an enlarged sectional view showing the first and second guide members shown in FIG. 2.

Referring now to FIG. 2, the cigarette cutting apparatus 20 will be described. The cigarette cutting apparatus 20 may be applied to high-speed cigarette making machines. The cigarette cutting apparatus 20 includes a substantially disk-shaped rotating head 30 which is tilted at an angle $\alpha$ (FIG. 4) to the vertical direction or an axis perpendicular to the travelling direction A of the continuous cigarette rod. Two cutting edges 32 extending at right angles to the travelling direction A of the continuous cigarette rod are attached to diametrically opposite portions of a peripheral surface 30*a* of the rotating head 30. Protruding from the peripheral surface 30*a* of the rotating head 30, the cutting edges 32 extend vertically. The cutting edges are 0.15 to 0.2 mm in thickness and 40 to 50 mm in width. As best seen in FIGS. 3, 5 and 6, the cutting edges are flat and have a curved edge. One end of a first rotating shaft 34 crossing the rotating head 30 at right angles is coupled to the center of the rotating head 30. A first bevel gear 36 is coaxially fixed to the intermediate portion of the first rotating shaft 34 near the other end thereof.

The first bevel gear 36 is meshed with a second bevel gear 40 coaxially fixed to one end portion of a second rotating shaft 38 which extends at right angles to the first rotating shaft 34. A first spur gear 42 is fixed to the other end portion of the second rotating shaft 38, and a gear 44 is provided between the second bevel gear 40 and the first spur gear 42 so as to rotate together with the second rotating shaft 38. As shown in FIG. 5, a cog belt 44*a* is passed around the gear 44. The cog belt 44*a* is also passed around a transmission gear (not shown) whch is coupled to a shaft 45*a* which supports a grindstone 45 for grinding the cutting edges 32. The first spur gear 42 is meshed with a second spur gear 48 fixed to one end portion of a third rotating shaft 46 which extends parallel to the second rotating shaft 38. A gear 50 is fixed to the other end portion of the third rotating shaft 46. As shown in FIG. 2, the gear 50 is coupled with a gear 102 mounted on a fourth rotating shaft 101, the shaft 101 being rotated by a motor (not shown), via a cog belt 103 passed around the gear 102 and the gear 50. Thus, the rotatory force of the motor is transmitted to the gear 50. A pulse signal generator 106 which transmits pulse signals to the density detector 18 is provided near the gear 102.

Mechanisms surrounding the rotating head 30 will now be described in detail.

As shown in FIGS. 2 and 3, first and second guide members 52 and 54, located on the upper- and lower-course sides, respectively, with respect to the travelling direction of the continuous cigarette rod, are arranged at a distance a little wider than the thickness of the cutting edges 32 so that their inner surfaces face each other. The guide members 52 and 54 are each formed of a plate with a hardened surface, extending in the circumferential direction of the rotating head 30. As shown in FIG. 6, a slightly curved portion 52*a* is formed on the inner surface of the first guide member 52 so that the inner surface is conformable in shape to the locus of movement of each cutting edge 32. A substantially flat portion 54*a* is formed on the inner surface of the second guide member 54. Through holes 56 and 58 are bored through the first and second guide members 52 and 54, respectively, through which the continuous cigarette rod travels. Pipe portions 60 and 62 protrude from the outer surfaces of the guide members 52 and 54, respectively. The through holes 56 and 58 and the pipe portions 60 and 62 are coaxial, and have a circular cross section which is a little wider than that of the cigarette rod so that the cigarette rod can pass through them.

As the rotating head 30, which is tilted at an angle of $\alpha$ to the vertical direction, is rotated, the cutting edges 32 are rotated together therewith, and are moved parallel in the travelling direction of the continuous cigarette rod. The peripheral speed of the rotating head 30 and the transfer speed of the continuous cigarette rod are adjusted so that the speed of the parallel movement of the cutting edges 32 is equivalent to the transfer speed of the continuous cigarette rod. Accordingly, the cutting edges 32 cut the continuous cigarette rod while being moved in the same direction as the cigarette rod, so that the cut end of each cigarette produced can be made perpendicular to the longitudinal direction of the cigarette.

While the rotating head 30 is rotating, the cutting edges 32 are gradually extruded by a conventional extruding means. Disposed beside the rotating head 30 is the grindstone 45 which touches and grinds the cutting edges 32 while the cutting edges 32 are being rotated. Thus, the cutting edges 32, which are continually extruded and ground, can be kept sharp at all times.

Figure 4:
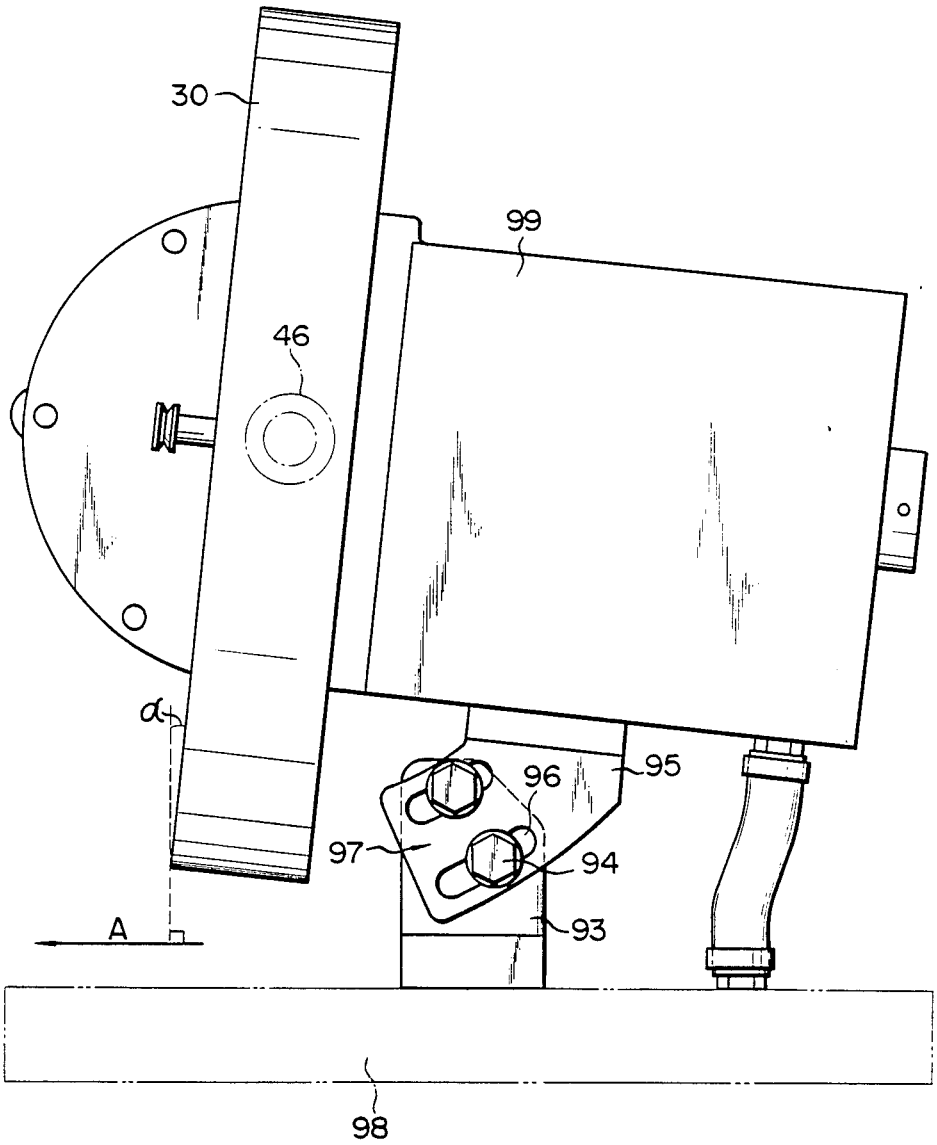
FIG. 4 is a side view of the continuous cigarette rod cutting apparatus shown in FIG. 2.

A drive mechanism for the rotating head 30 described above is contained in a housing 99, as shown in FIG. 4. The housing 99 is supported on a base 98 by a support mechanism 97 so that it can rotate around the third rotating shaft 46. The support mechanism 97 includes a first lug 95 protruding from the housing 99 and having slant slots 96, and a second lug 93 protruding from the base 98 and having screws 94 passed through the slots 96. The first and second lugs 95 and 93 are coupled together by pressing the first lug 95 against the second lug 93 by means of the screws 94. The tilt angle of the rotating head 30 can be changed by loosening the screws 94, rotating the first lug 95 relative to the second lug 93, and then tightening the screws 94 when a desired position is reached.

The operation of the cigarette cutting apparatus with the above described construction will now be described.

The motor (not shown) is driven to rotate the rotating head 30 in the clockwise direction of FIG. 3 through the medium of the gear 50, second spur gear 48, first spur gear 42, second bevel gear 40, and first bevel gear 36 in succession, as shown in FIG. 2. At the same time, the continuous cigarette rod is continuously fed forward or in the direction of arrow A in FIG. 6. The continuous cigarette rod fed in this manner is passed through the first pipe portion 60, the through hole 56 of the first guide member 52, the gap between the first and second guide members 52 and 54, the through hole 58 of the second guide member 54, and the second pipe portion 62. The rod is vertically cut by the rotating cutting edges 32 between the first and second guide members 52 and 54. The cutting edges 32 touch the respective inner surfaces of the first and second guide members 52 and 54 when they pass between them. Accordingly, the cutting edges 32 are prevented from vibrating in the direction of the thickness thereof due to the high-speed rotation of the rotating head 30. Since the inner surface of the first guide member 52, on which the cutting edges 32 slide, is curved with substantially the same curvature as the movement locus of the cutting edges 32, the oscillation can be prevented more surely. Thus, the cigarette rod is cut twice every time the rotating head 30 makes one revolution.

The manner of changing the cut length of the cigarette rod will now be described.

The rotating head 30 is moved around the central axis of the third rotating shaft 46 so that the tilt angle $\alpha$ of the rotating head 30 becomes wider (for longer cigarettes) or narrower (for shorter cigarettes). In other words, the angle of the axis of rotation of the rotating head 30 to the travelling direction of the cigarette rod is changed. As the rotating head 30 is rocked in this manner, the cutting edges 32 are tilted corresponding to the rocking angle $\alpha$ of the rotating head 30 with respect to the vertical axis. Therefore, the cutting edges 32 are rocked through the same angle with respect to the rotating head 30 and oppositely directed so that they extend vertically. The rotational frequency of the rotating head 30 is changed in accordance with the change in the tilt angle. If the tilt angle $\alpha$ is wider, the rotational frequency of the rotating head 30 is lowered. If the former is narrower, the latter is increased. Meanwhile, the transfer speed of the cigarette rod is constant. After the apparatus is thus adjusted, the cigarette rod is cut in the aforementioned manner. The rotating head 30 can be rocked together with the drive mechanism and drive transmission mechanism by changing the angle of the housing 99 shown in FIG. 4.

If the cigarette cutting apparatus can produce 8,000 cigarettes per minute, the rotating speed of the cutting edge is about 80 m per second, and the speed of the movement of the cutting edge in the travelling direction of the continuous cigarette rod is about 8 m per second. In the prior art apparatuses without the guide members, the amplitude of the oscillation of the cutting edge is about 0.5 mm, the cut end of each cigarette is curved, and the cutting edge is liable to be damaged. However, in the cigarette cutting apparatus of the present invention, which is provided with the guide members 52 and 54, the cutting edges 32 are prevented from vibrating. Therefore, the cut end of each cigarette cut by the cutting edges 32 is straight, and the cutting edges 32 cannot easily be damaged. Moreover, the cutting edges 32 can continually be ground by the grindstone 45 to maintain their sharpness.

Figure 7:
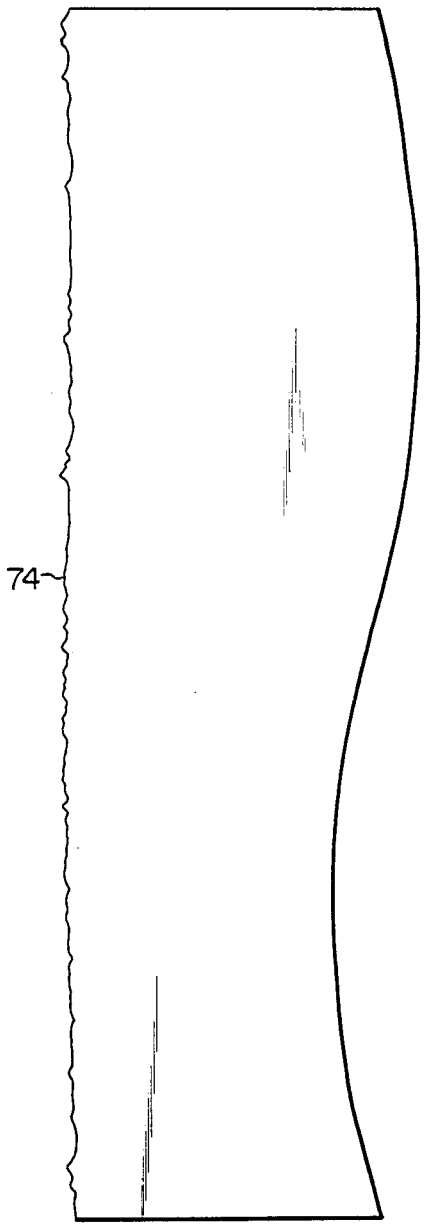
FIG. 7 is an enlarged view showing a cut end of an unrolled wrapper web of a cigarette cut by a prior art continuous cigarette rod cutting apparatus of a cigarette making machine.
Figure 8:
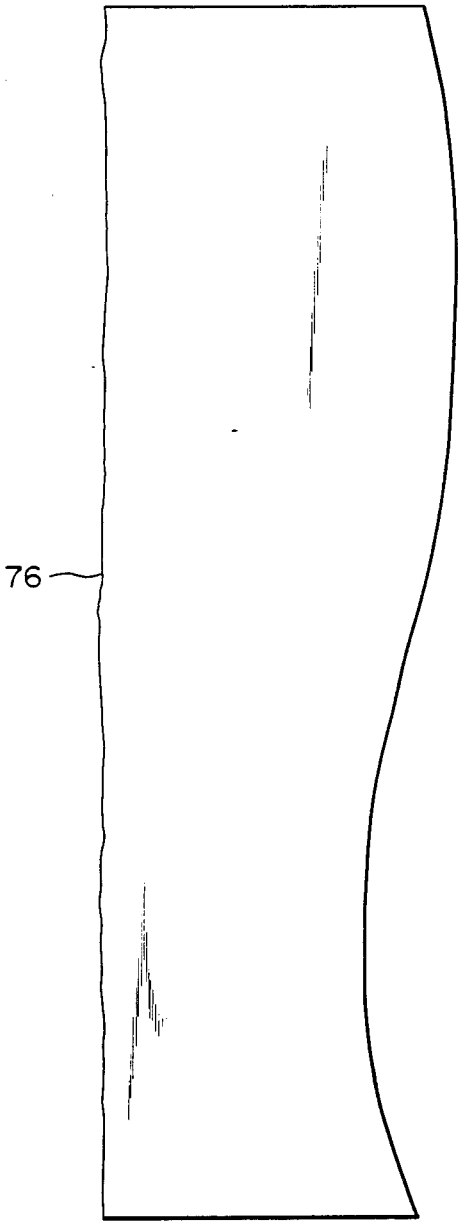
FIG. 8 is an enlarged view showing a cut end of an unrolled wrapper web of a cigarette cut by the continuous cigarette rod cutting apparatus of a cigarette making machine shown in FIG. 2.

FIG. 7 is an enlarged view (tenfold) showing a cut end 74 of an unrolled wrapper web of a cigarette cut by a conventional cigarette cutting apparatus which can produce 4,000 cigarettes per minute. FIG. 8 is an enlarged view (tenfold) showing a cut end 76 of an unrolled wrapper web of a cigarette cut by the cigarette cutting apparatus according to the present invention which can produce 8,000 cigarettes per minute. The cut error of the cut end 74 shown in FIG. 7 ranges from 0.2 mm to 0.25 mm, while that of the cut end 76 shown in FIG. 8 is within 0.1 mm.

In the apparatus of the embodiment described above the disk-shaped rotating head is used for the rotating member. However, the present invention is not limited to the embodiment. The number of cutting edges is not limited to two, and any number of cutting edge(s) may be used according to the application. The inner surfaces of the guide members may be any shape in the above embodiment. It is necessary only that the cutting edge be able to touch the inner surfaces to be prevented from oscillating in the direction of the thickness thereof, when it passes between the inner surfaces.

The cigarette rod cutting apparatus in the present invention can be used to cut not only a cigarette rod but also any rod-shaped material, such as a filter for a cigarette. The shape of the rotating head 30 is not limited to a disc shape, but it may be a quadrilateral shape, a pentagonal shape, etc.

What is claimed is:

1. A cutting apparatus for cutting a moving continuous cigarette rod into cigarettes, comprising:

a rotating member rotatable around an axis of rotation tilted with respect to a travelling direction of the continuous cigarette rod;

drive means for rotating said rotating member;

at least one cutting edge attached to the rotating member so as to extend perpendicular to the travelling direction of the continuous cigarette rod and to rotate together with the rotating member, said cutting edge thereby cutting the moving continuous cigarette rod perpendicular to the travelling direction thereof; and a pair of fixed guide members each having a hole through which the continuous cigarette rod travels and an inner surface, the respective inner surfaces of said two guide members facing each other at a space wider than the thickness of the cutting edge and fixedly positioned adjacent the locus of movement of said cutting edge wherein said pair of guide members includes a first guide member located on the upstream side with respect to the travelling direction of the continuous cigarette rod and a second guide member located downstream thereof, the inner surface of said first guide member including a curved portion having a non-flat curvature conforming to the locus of movement of the cutting edge, said curvature providing a means for maintaining sliding contact with the cutting edge in response to adjustment of the cutting edge along the travelling direction of the rod, thereby preventing the cutting edge from vibrating in the direction of the thickness thereof.

2. The cutting apparatus according to claim 1, wherein the inner surface of said second guide member includes a substantially flat portion.

3. The cutting apparatus according to claim 1, wherein at least one of said pair of guide members is formed of a plate with a hardened surface.

4. The cutting apparatus according to claim 1, wherein said pair of guide members have their respective outer surfaces opposite to the inner surfaces, said cutting apparatus further comprising pipe portions protruding individually from the outer surfaces of the two guide members, said pipe portions extending coaxially with the holes in the guide members so that the continuous cigarette rod can pass through the pipe portions and the holes.

5. The cutting apparatus according to claim 1, wherein said rotating member includes a substantially disk-shaped rotating head, said cutting edge protruding from the peripheral surface of the rotating head.

6. The cutting apparatus according to claim 5, wherein said first and second guide members extend a predetermined length along the circumferential direction of the rotating head.

7. The cutting apparatus according to claim 1, wherein said drive means includes a rotating shaft, having a central axis and transmission means for transmitting the rotatory force of the rotating shaft to the rotating member, and further comprising means for tilting the rotating member around an axis connecting the central axis of the rotating shaft.

8. The cutting apparatus according to claim 7, wherein said tilting means includes a support mechanism for tilting the rotating member around the central axis of the rotating shaft.

* * * * *